United States Patent [19]

Kotthoff et al.

[11] 4,047,558

[45] Sept. 13, 1977

[54] METERING DEVICE FOR METAL CASTING MACHINES, PARTICULARLY LOW PRESSURE CASTING MACHINES

[75] Inventors: Winfried Kotthoff, Eversberg; Wolfgang Wiedenroth, Meschede (Ruhr), both of Germany

[73] Assignee: Honsel Werke Aktiengesellschaft, Germany

[21] Appl. No.: 590,276

[22] Filed: June 25, 1975

[30] Foreign Application Priority Data

June 28, 1974 Germany ..... 2431108

[51] Int. Cl.[2] ..... B22D 11/16; B22C 19/04

[52] U.S. Cl. ..... 164/309; 164/155; 425/145

[58] Field of Search ..... 164/4, 119, 133, 154, 164/155, 157, 285, 306, 309; 425/145, 146, 147, 149; 235/151.1

[56] References Cited

U.S. PATENT DOCUMENTS

| | | | |
|---|---|---|---|
| 3,302,254 | 2/1967 | Moriyama | 164/155 |
| 3,385,473 | 5/1968 | Forcesi | 164/155 UX |
| 3,459,254 | 8/1969 | Dearth | 164/119 |
| 3,844,331 | 10/1974 | Py et al. | 164/4 |
| 3,861,457 | 1/1975 | Py | 164/4 |
| 3,920,367 | 11/1975 | Ma et al. | 235/151.1 X |

*Primary Examiner*—Francis S. Husar
*Assistant Examiner*—John S. Brown
*Attorney, Agent, or Firm*—Hill, Gross, Simpson, Van Santen, Steadman, Chiara & Simpson

[57] ABSTRACT

A metering device and method for introducing molten metal from a reservoir into a mold, the metering device including a pilot valve, a control valve actuated by the pilot valve, and an analog computer controlling operation of the pilot valve, the computer receiving signals corresponding to the speed of filling of the mold, the magnitude of the pressure up to solidification of the first casting in the mold, and the change in pressure in the reservoir due to decrease in the metal level in the reservoir.

2 Claims, 2 Drawing Figures

METERING DEVICE FOR METAL CASTING MACHINES, PARTICULARLY LOW PRESSURE CASTING MACHINES

BACKGROUND OF THE INVENTION

1. Field of the Invention

This invention is in the field of metering devices and metering methods for controlling the flow of molten metal from a reservoir to a casting mold, and utilizing computer generated signals dependent upon the pressure conditions existing in the reservoir.

2. Description of the Prior Art

Pressure control means for casting devices, particularly for low pressure casting of aluminum have been developed but, for the most part, these have the disadvantage that they do not respond promptly and accurately to the variables such as the amount of metal in the reservoir, pressure and the speed of filling of the casting mold. Consequently, the casting may be non-uniform because the casting variables are not accurately reproduced so the castings may vary from each other as to shape and quality.

There is a regulating device known in which during the interval between two casting operations, a correction of the gas pressure in the reservoir is undertaken because of the decreased level of the molten bath in the reservoir. An exact regulation of greater volumes within small units of time is, however, not possible when using electrically regulated valves.

Such prior art devices frequently make use of two pressurizing steps, a higher pressure to bring the melt out of the reservoir into the casting mold, and a lower pressure in order to fill the mold (see, for example, German Laid Open Specificaton No. 2,435,734). In this type of system, prior art valves may be utilized as discussed in German Laid Open Specificaton No. 1,558,166 which cooperate with two control valves for the two different pressure steps.

SUMMARY OF THE INVENTION

The present invention provides a metering device in which an exact regulation of the casting operation may be attained with relatively simple means by responding directly to the quantity of melt removed from the reservoir per each casting piece, the filling speed of the mold, and the duration of time up to solidification of the first casting piece in the mold so that an exact, accurately reproducible casting results.

In accordance with the present invention, we provide a device in which a pilot valve cooperates with a control valve and the pilot valve is controllable by means of the control current of an analog computer which is fed with signals dependent upon the rate of metal flow up to solidification of the first casting in the mold, the change of flow on account of the decrease in the quantity of molten metal in the reservoir, and the speed of increase in the flow upon filling of the casting mold.

The regulation of the timewise variation of the control current takes place according to a pressure-time diagram of the analog computer with an integrated operation amplifier, whereby for controlling the casting sequence, the following three variables are introduced into the computer:

1. The rate of metal flow up to solidification of the first casting piece,

2. The necessary change of flow on account of the decrease in the quantity of melt during the casting procedure, and

3. The speed of increase in the flow upon filling of the mold.

In addition to these variables, there may be introduced into the computer or to the control valve or pilot valve through a time relay the length of solidification for the casting pieces.

It is particularly advantageous if the three or four mentioned variables are fed continuously to the computer individually in each case through a potentiometer which is actuated by each variable. Thus, a very precise control of the casting operated is possible with respect to the accuracy of the charge.

The pressure of the gas in the pressure conduit in front of the control valve and the stabilization of the pressure in the control gas before the pilot valve may be accomplished by means of a fines valve and a pressure reducing valve. It is also advantageous to incorporate a 3/2-way magnet valve and a safety valve in the feed conduit between the control valve and the reservoir. It is also advantageous to provide a return conduit parallel to the feed conduit of the pressure gas to the reservoir.

BRIEF DESCRIPTION OF THE DRAWINGS

Other objects, features and advantages of the invention will be readily apparent from the following certain of certan preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
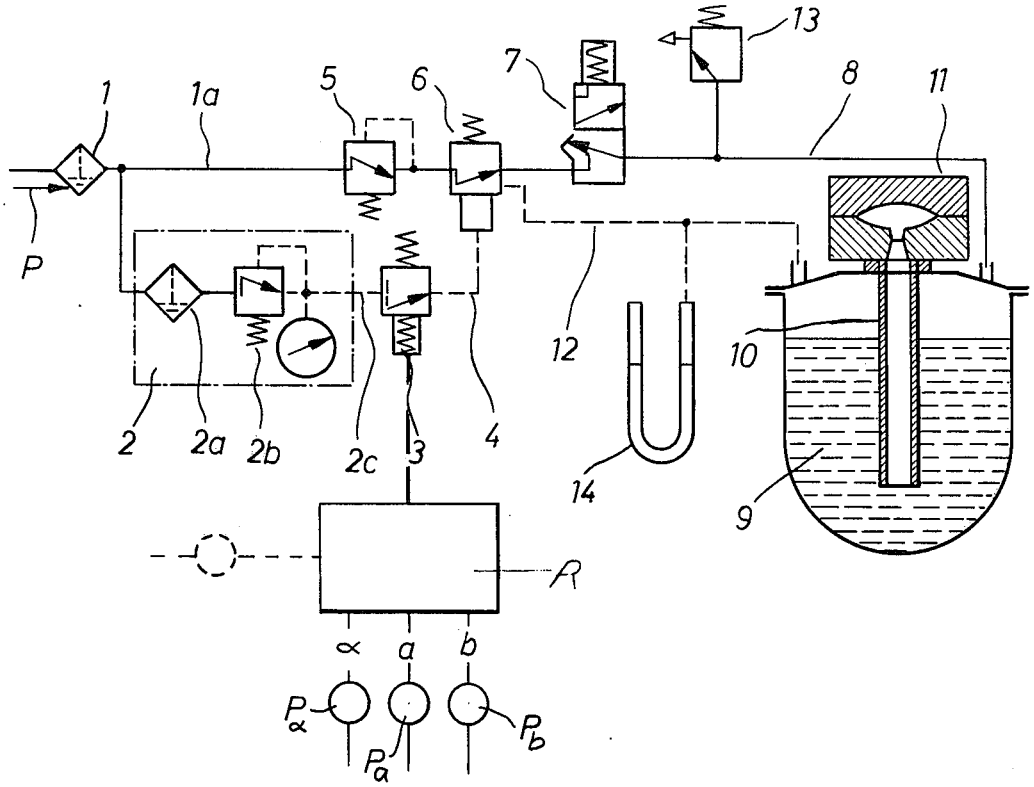
FIG. 1 is a somewhat schematic view illustrating a pneumatic control for a low pressure casting device used with a mold fed by means of fluid pressure.

In the system shown in FIG. 1, compressed air is introduced through a line P, and particles of dirt and water may be separated from the compressed air by means of a fines filter 1 equipped with a water separator. In a pressure reducing station 2, there is a further fines filter **2*a* and a pressure reducing valve 2*b*, where the compressed air is again cleaned as well as having its pressure reduced to about 1.3 atmospheres. Pressure is fed by means of a conduit 2*c* to the inlet side of an electrically controllable pilot valve 3 whose pressure on the outlet side is fed to a conduit 4 and is proportional to the current flowing in the coil of the electrically operated pilot valve 3. The pilot valve 3 is arranged to handle a small volume of air and cannot directly handle the substantial pressure in the conduit 1*a***.

The pressure in the conduit 4 is applied to a control valve such as a gate valve 6 in which there is a chamber closed by means of a diaphragm which is acted upon by the air in the conduit 4 under pressure. A pressure reducing valve 5 is connected between the filter 1 and the control valve 6 in order to exclude fluctuations in pressure in the conduit **1*a*. This pressure reducing valve 5 as well as the control valve 6 itself have sufficiently large cross-sectional areas to handle the required quantity of pressurized gas. The pressure is conveyed through an energized 3/2-way magnet valve 7 through a supply conduit 8 into a closed melt reservoir 9. The pressure in the reservoir 9 causes liquid metal in the reservoir to be forced though a pipe 10 into a mold 11. There is also provided a parallel circuit consisting of a return conduit 12 which is disposed between the reservoir 9 and the control valve 6. In the supply conduit 8 there is installed a safety valve 13 which prevents the accumulation of undesired excess pressure. The pressure prevailing in the conduit 12 may be read on a manometer 14.**

The pilot valve 3 is under the control of an analog computer R to which signals corresponding to the various variables are fed. The speed of filling of the mold is identified at ($\alpha$), the variable ($a$) refers to the rate of metal flow up to solidification of the first casting piece, and the variable (b) refers to the change in pressure due to the decrease of the melt volume in the reservoir 9 at each casting operation. The introduction of the individual variables, ($\alpha$), ($a$) and ($b$) takes place preferably continuously through potentiometers $P_\alpha$, $P_a$ and $P_b$.

The computer R delivers the control signals to the magnet of the pilot valve 3.

Figure 2:
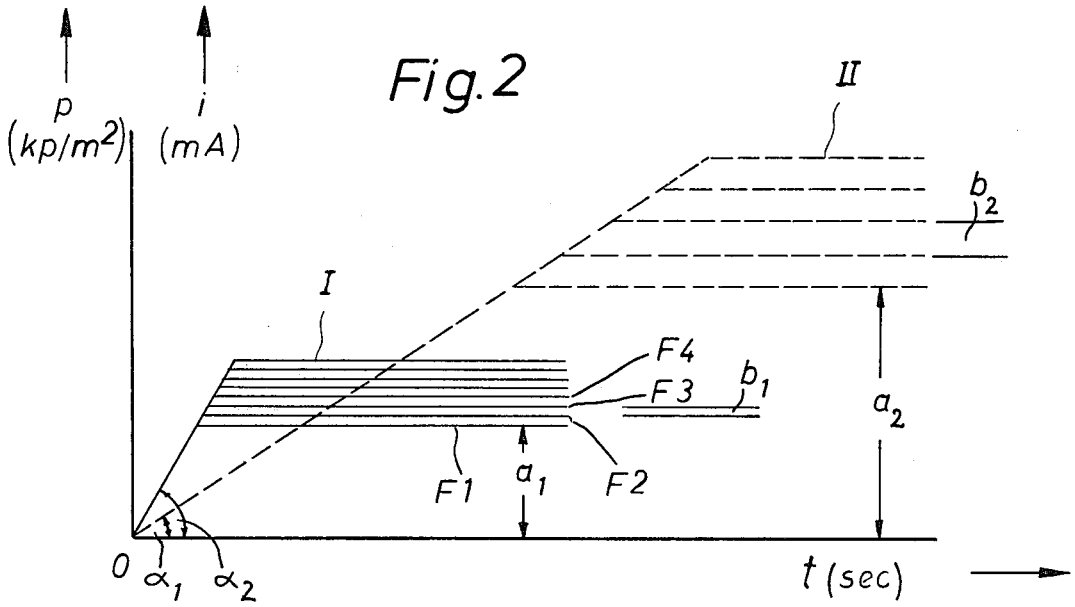
FIG. 2 is a pressure-time diagram of two casting steps showing the dependence of the control current to the pilot valve from a time after commencement of the casting operation for the casting of two different pieces.

In the pressure-time or control-current time diagrams I and II for two casting pieces illustrated in FIG. 2, the pressure $p$ in the reservoir 9 and the control current $i$ proportional to it fulfills the reqirements as to casting techniques for two differnt casting pieces as follows.

For a first casting piece identified at diagram I, the filling speed of the mold is related to the increase in the flow ($\alpha_1$), while the variable (a) indicates the pressure and, therefore, the flow rate up to solidification of the first casting piece. The symbol $b_1$ represents the necessary rise in temperature and, therefore, the flow change between successive fillings $F_1$, $F_2$, $F_3$, $F_4$, and so on of the mold. The lines in the diagram extending horizontally indicate the solidification time of the casting pieces which may be introduced into the computer R or they may be passed to the pilot valve 3 or the control valve 6 by means of time relays.

The control flow-time diagram II is appropriate for a second casting piece with greater volume. The rise in flow ($\alpha_2$) or the speed in the rise of pressure, respectively, is smaller and the filling time of the mold 11 is longer. It should also be recognized that the rate of metal flow ($a_2$) and the flow change ($b_2$) is greater between each individual casting operation.

The regulation of the duration of the electrical control signal for the pilot valve 3 occurs preferably through an analog integration step, an analog and digitally controlled multiplier as well as an analog adder and an impedance transformer as is well known to those skilled in the art. The magnitude of the three factors ($\alpha$), ($a$) and ($b$) determining the pressure control are adjusted continuously by means of the potentiometers $P_\alpha$, $P_a$ and $P_b$. The potentiometer shown in dotted lines to the left of computer R may serve for the control of the duration of rigidification of the casting pieces. Through the analog computer with integrated operation amplifier, the straight rise of the diagrams I and II in FIG. 2, that is, the constancy of the casting speed and the precision of the previously selected adjusted values is attained. This brings about a high accuracy, constant and reproducible casting operation and thereby provides a high grade uniform casting.

If desired, the rise in flow rate ($\alpha$) shown in straight lines in the diagrams may also follow an irregular straight line, so that first a rapid filling of the conduit 10 takes place and subsequently a slower filling of the mold as is known to those skilled in the art.

As may be seen from diagrams I and II, the dimension (a), represents the pressure with which the melt for each casting is transmitted out of the reservoir 9 through the conduit 10 into the mold 11. As the level of the melt in the reservoir 9 drops during a casting operation, the melt column in the conduit 10 becomes higher and requires an increase in pressure up to the dimension (b) above the pressure with the previous casting, so that the rise in pressure (b), as indicated above, indicates a measure for the volume of the casting piece.

We claim as our invention:

1. In a metal casting machine including a mold, a reservoir connected to the said mold, and gas pressure means connected to said reservoir for delivering molten metal from said reservoir to said mold, a pressure control device comprising a control valve, a pilot valve feeding said control valve with a predetermined gas pressure, and a conduit communicating said control valve with the pressure in said reservoir, said control valve functioning as a differential pressure valve to apply the difference in pressures across said control valve as a control for said gas pressure means.

2. A casting machine according to claim 1 in which said pilot valve is a servo valve electrically controllable by a computer.

* * * * *